US007186939B2

(12) United States Patent
Sera et al.

(10) Patent No.: US 7,186,939 B2
(45) Date of Patent: Mar. 6, 2007

(54) MOVABLE CONTACT UNIT AND PANEL SWITCH

(75) Inventors: Naoki Sera, Okayama (JP); Hiromichi Koyama, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/268,508

(22) Filed: Nov. 8, 2005

(65) Prior Publication Data

US 2006/0125174 A1 Jun. 15, 2006

(30) Foreign Application Priority Data

Dec. 10, 2004 (JP) ..... 2004-357846

(51) Int. Cl.
*H01H 1/10* (2006.01)

(52) U.S. Cl. ..... 200/516; 200/406; 29/622

(58) Field of Classification Search ..... 29/622; 200/511–517, 406

See application file for complete search history.

(56) References Cited

U.S. PATENT DOCUMENTS 5,924,555 A * 7/1999 Sadamori et al. ..... 200/512
6,259,046 B1 * 7/2001 Iwama et al. ..... 200/5 A
6,593,537 B2 * 7/2003 Teruyama et al. ..... 200/515
6,604,278 B2 * 8/2003 Sera et al. ..... 29/622
6,917,007 B2 * 7/2005 Hirai et al. ..... 200/516
6,924,448 B2 * 8/2005 Sera et al. ..... 200/516
6,982,394 B2 * 1/2006 Ide et al. ..... 200/516

FOREIGN PATENT DOCUMENTS

JP 10-188728 7/1998

* cited by examiner

*Primary Examiner*—Michael A. Friedhofer
(74) *Attorney, Agent, or Firm*—Wenderoth, Lind & Ponack, L.L.P.

(57) ABSTRACT

A small movable contact unit and a panel switch which prevent peeling from an edge even though the width between the edge of a base sheet and a movable contact is narrowed. The movable contact unit includes the movable contact and base sheet. The movable contact has a round dome shape and is made of a resilient metal sheet. The base sheet is an insulating film which adheres a dome tip of the movable contact with an adhesive applied to its undersurface for holding the movable contact at a predetermined position. A supplementary adhesive is applied to a ring non-adhesive area of the movable contact disposed near the edge of the base sheet at a portion toward the edge of the base sheet. Accordingly, the movable contact disposed near the edge is adhered to and held by the base sheet using the adhesive including the supplementary adhesive.

12 Claims, 6 Drawing Sheets

MOVABLE CONTACT UNIT AND PANEL SWITCH

BACKGROUND OF THE INVENTION

1. Field of the Invention

The present invention relates to movable contact units for panel switches that typically configure control panels of electronic devices, and panel switches configured using the movable contact unit.

2. Background Art

Mobile electronic devices such as cellular phones and PDAs (Personal Digital/Data Assistants) are increasingly being used in recent years. These electronic devices are being constantly downsized to improve their portability, so the panel switches used in their control panels need to be made smaller. A conventional movable contact unit employed in these panel switches and a panel switch configured with a conventional movable contact unit are described next with reference to FIGS. 4 to 6. FIG. 4 is a sectional view of the conventional movable contact unit, FIG. 5 is an exploded perspective view of the same movable contact unit, and FIG. 6 is a sectional view of a panel switch configured using the same movable contact unit.

In FIGS. 4 and 5, the movable contact unit includes movable contact 1 and base sheet 2. Movable contact 1 consists of a thin resilient metal sheet that is dome-shaped, with convex top and open bottom, and its circumference is round. Base sheet 2 is an insulating film, made typically of polyethylene terephthalate (PET). Base sheet 2 adheres to and supports dome tip 1A of each of movable contacts 1 disposed at predetermined positions with its undersurface where adhesive 3 is applied.

Adhesive 3 on the undersurface of base sheet 2 is applied to the entire undersurface of base sheet 2 except for a portion corresponding to a peripheral area of each movable contact 1. In other words, the portion corresponding to the peripheral area of each movable contact 1 forms an independent circular ring of non-adhesive area 3A. Dome tip 1A is adhered to adhesive 3 applied to a circular area inside non-adhesive area 3A, and thus each movable contact 1 is held by the undersurface of base sheet 2.

As shown in FIG. 6, the conventional movable contact unit as configured above is used, for example, in a panel switch. In FIG. 6, each fixed contact 4 configured with a pair of outer fixed contact 4A and central contact 4B is disposed respectively at positions corresponding to each of movable contacts 1 in the movable contact unit. Peripheral lower end 1B of each movable contact 1 is positioned on each outer fixed contact 4A, and bonded with adhesive 3 on the undersurface of base sheet 2.

In FIG. 6, each outer fixed contact 4A is electrically contiguous with corresponding movable contact 1, and the undersurface of dome tip 1A of each movable contact 1 faces corresponding central fixed contact 4B with a distance in between. Movable contacts 1 disposed and adhered at predetermined positions on the undersurface of base sheet 2 respectively configure independent switches, and thus the panel switch is configured as a whole.

Non-adhesive area 3A is provided on the area corresponding to the periphery of each movable contact 1 in the application pattern of adhesive 3 to avoid unwanted adhesive 3 from extending to underneath the lower end of movable contact 1 when configuring the panel switch. A protective sheet made of an insulating film is attached to and covers the entire undersurface of base sheet 2 of the movable contact unit to protect movable contact 1 from dust, etc., during transportation and storage. This protective sheet is usually removed when bonding the movable contact unit onto wiring board 5.

Each switch on the panel switch operates such that dome tip 1A of movable contact 1 is depressed via base sheet 2 using the push button (not illustrated) of the electronic device. This pressing force resiliently deforms the dome portion of movable contact 1, giving tactile feedback, and the undersurface of dome tip 1A contacts central fixed contact 4B underneath. Outer fixed contact 4A and central fixed contact 4B thus becomes electrically contiguous, at which point the switch is turned on.

When the pushing force is released, the dome portion of movable contact 1 reverts to its original dome shape with convex tip at the top, giving tactile feedback, and thus the undersurface of dome tip 1A separates from central fixed point 4B. This breaks the electrical contact between outer fixed contact 4A and central fixed contact 4B as shown in FIG. 4, and thus the switch returns to the original off state. These conventional configurations of the movable contact unit and panel switch are disclosed, for example, in the Japanese Patent Unexamined Publication No. H10-188728.

The above conventional movable contact unit and the panel switch using the conventional movable contact unit have been downsized by narrowing the distance between the edge of base sheet 2 and movable contact 1 disposed near the edge, in line with downsizing of devices where the switch is installed.

However, it is necessary to ensure that base sheet 2 does not peel off from the edge when the movable contact unit is bonded to wiring board 5 and the panel switch is configured, including the times when each switch is operated. Width A shown in FIG. 6 where adhesive 3 is applied between the edge of base sheet 2 and circular-ring non-adhesive area 3A needs to be set to a distance that can safely retain an adhesive strength state. Accordingly, the above way of downsizing the conventional movable contact unit and panel switch is simple and effective but has its limits.

SUMMARY OF THE INVENTION

The present invention aims to offer a downsized movable contact unit and a panel switch using this movable contact unit that can prevent the peeling of a base sheet from its edge even though the distance between the edge of the base sheet and the movable contact disposed near the edge is set narrower than that of the prior art.

The movable contact unit of the present invention includes a movable contacts and a base sheet. The movable contact is made of a resilient metal sheet formed into a round dome shape with an open bottom. The base sheet is an insulating film which adheres to the dome tip of the movable contact with an adhesive applied to its undersurface, which holds the movable contacts at predetermined positions respectively. An adhesive is applied to the undersurface of the base sheet such that a ring-shaped non-adhesive area where no adhesive is applied is formed on the periphery of each of the movable contacts disposed at the center of the base sheet.

For the movable contacts disposed near the edge of the base sheet, a supplementary adhesive is applied to a portion of the ring non-adhesive area toward the edge of the base sheet. This supplementary adhesive is applied in a way so as to reach the adhesive applied to a border of the base sheet. Accordingly, the movable contacts disposed near the edge are also adhered and held by the base sheet with this supplementary adhesive.

In this configuration, the movable contacts disposed near the edge of the base sheet are adhered to and held by the base sheet also using the supplementary adhesive. Accordingly, an adhesive area and the adhesive strength required on the border of the base sheet can be secured, since the supplementary adhesive, applied so as to reach the adhesive formed on the border of the base sheet, additionally adheres to the base sheet and movable contacts. This prevents peeling of the base sheet from the edge even though the border of the base sheet is narrowed. In this way, a further downsized movable contact unit and panel switch are made feasible.

In the movable contact unit of the present invention, the same adhesive as that applied to the undersurface of the base sheet may be used as the supplementary adhesive. This allows the use of a single type of adhesive on the undersurface of the base sheet, and thus application of adhesive to the base sheet is performed in a single manufacturing step. Accordingly, the present invention reduces the border width of the base sheet through a simple process at low cost.

The panel switch of the present invention includes the above movable contact unit and wiring board. A pair of fixed contacts, including an outer fixed contact and a central fixed contact, are disposed on the top face of the wiring board at positions corresponding to each of movable contacts. A peripheral lower end of each movable contact is placed on a corresponding outer fixed contact, and bonded to and held onto the wiring board by adhesive applied to the undersurface of the base sheet. Accordingly, the use of the movable contact unit of the present invention achieves a small panel switch that can suppress peeling of the base sheet from the edge and also prevents contamination with dust and liquids.

DETAILED DESCRIPTION OF THE INVENTION

A preferred embodiment of the present invention is described next with reference to drawings.

Figure 1:
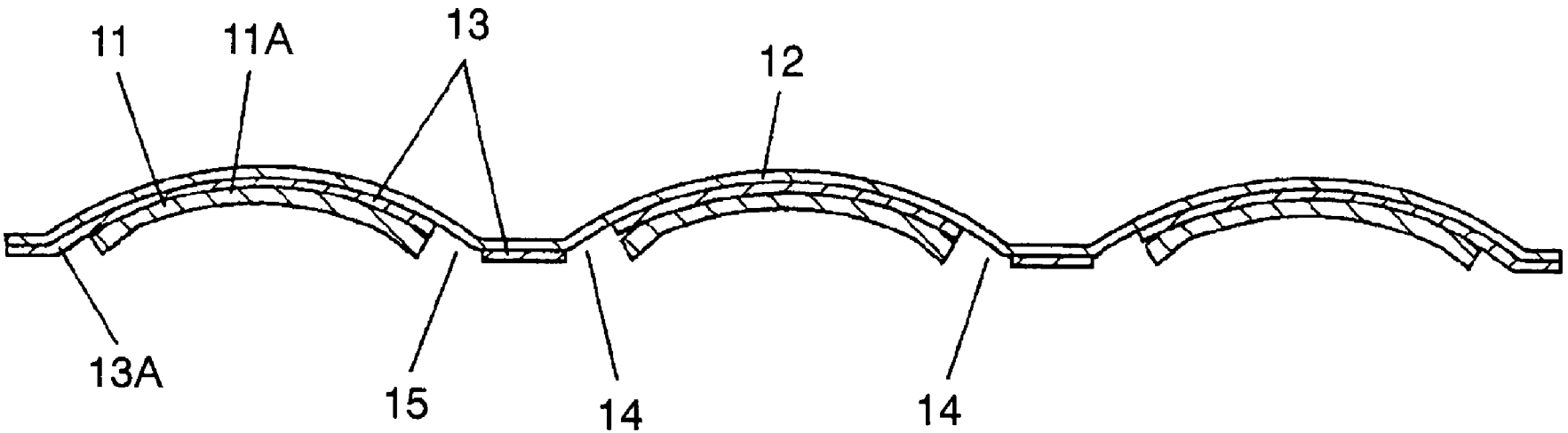
FIG. 1 is a sectional view of a movable contact unit in accordance with a preferred embodiment of the present invention.
Figure 2:
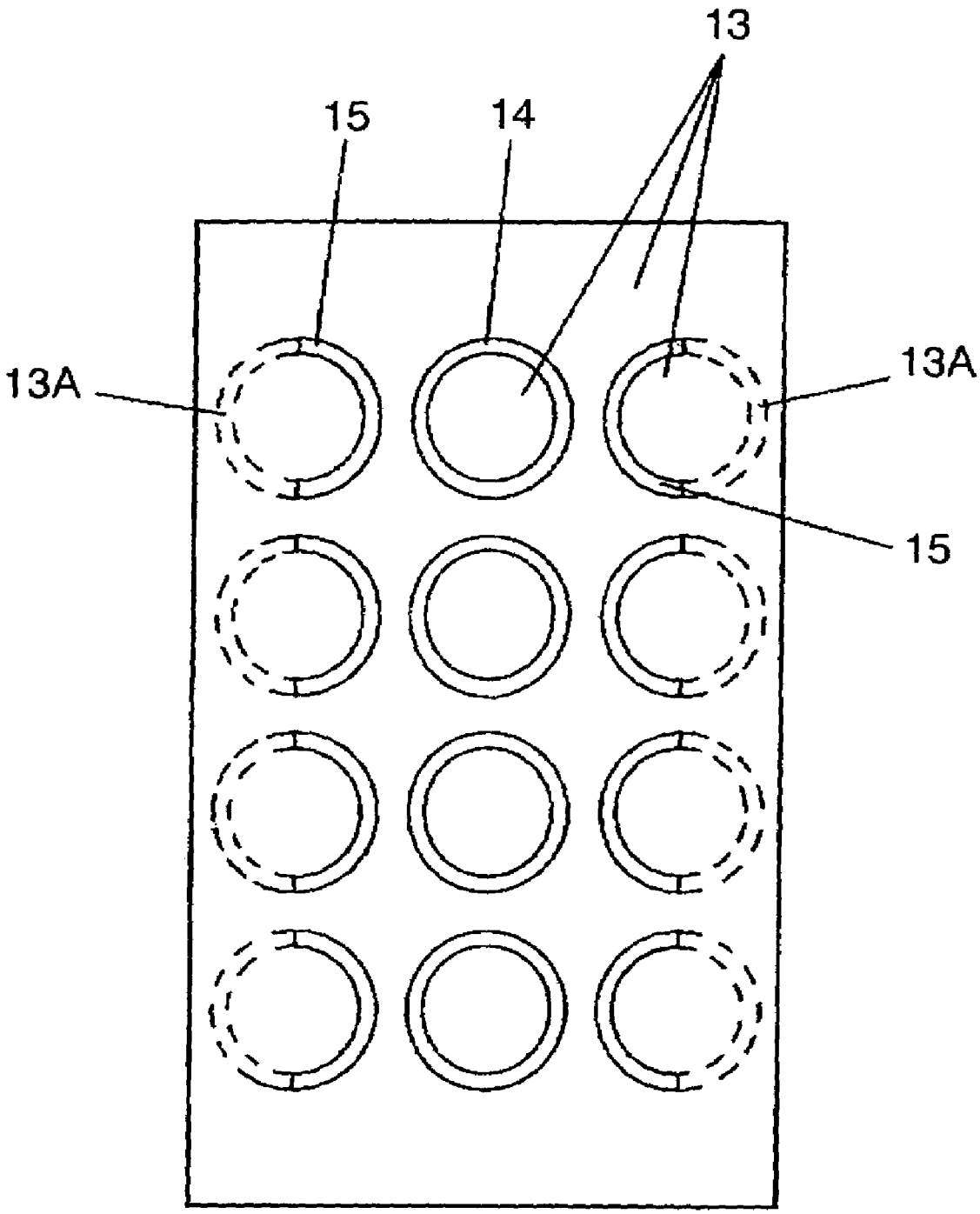
FIG. 2 is a bottom view of a base sheet of the movable contact unit in accordance with the preferred embodiment of the present invention.

FIG. 1 is a sectional view of a movable contact unit in the preferred embodiment of the present invention. FIG. 2 is a bottom view of a base sheet of the same movable contact unit.

In FIGS. 1 and 2, the movable contact unit includes movable contact 11 and base sheet 12. Movable contact 11 is made of a thin resilient metal sheet, and has the same structure as that in the prior art: Its outer shape is similarly round like a dome with a convex top and open bottom. Base sheet 12 is made of an insulating film. Adhesive 13 is printed on almost the entire undersurface of base sheet 12. Adhesive 13 adheres to and holds the top face of dome tip 11A of movable contact 11. Multiple movable contacts 11 are disposed at predetermined positions on base sheet 12.

Adhesive 13 on the undersurface of base sheet 12 is printed such that ring non-adhesive areas 14 where adhesive 13 is not applied in areas corresponding to the periphery of movable contacts 11 are created for movable contacts 11 disposed at the center of base sheet 12. The top face of dome tip 11A of each movable contact 11 adhered to and held with circular area of adhesive 13 formed inside corresponding non-adhesive area 14.

The movable contact unit of the present invention differs from the prior art at a point where an area on base sheet 12 corresponding to the periphery of each movable contact 11, disposed near the edge of base sheet 12, is set as semicircular non-adhesive area 15.

More specifically, as shown in FIG. 2, a bottom view of the base sheet, this semicircular non-adhesive area 15 is provided toward the center which is opposite the edge of base sheet 12. Same adhesive 13 as that for other areas of the undersurface is printed on a remaining semicircular portion toward the edge of base sheet 12. Adhesive 13 applied to form the semicircular area is called supplementary adhesive 13A in the following description.

A ring formed with non-adhesive area 15 and supplementary adhesive 13A corresponds to the periphery of movable contact 11. Supplementary adhesive 13A is applied in a way such that it at least reaches adhesive 13 applied to the border of the undersurface of base sheet 12. As shown in FIG. 1, the case where supplementary adhesive 13A touches adhesive 13 inside non-adhesive area 15 depending on the diameter or height of movable contact 11 is described next.

Movable contact 11 disposed near the edge of base sheet 12 is, as shown in FIG. 1, adhered to and held by base sheet 12 via adhesive 13 inside non-adhesive area 15 and supplementary adhesive 13A.

Since supplementary adhesive 13A reaching adhesive 13 applied to the border of base sheet 12 also adheres to base sheet 12 and movable contact 11 at the edge side, an adhesive area required on the border and sufficient adhesive strength can be secured. This enables placement of movable contacts 11 closer to the edge of base sheet 12, allowing downsizing of the movable contact unit.

Figure 3:
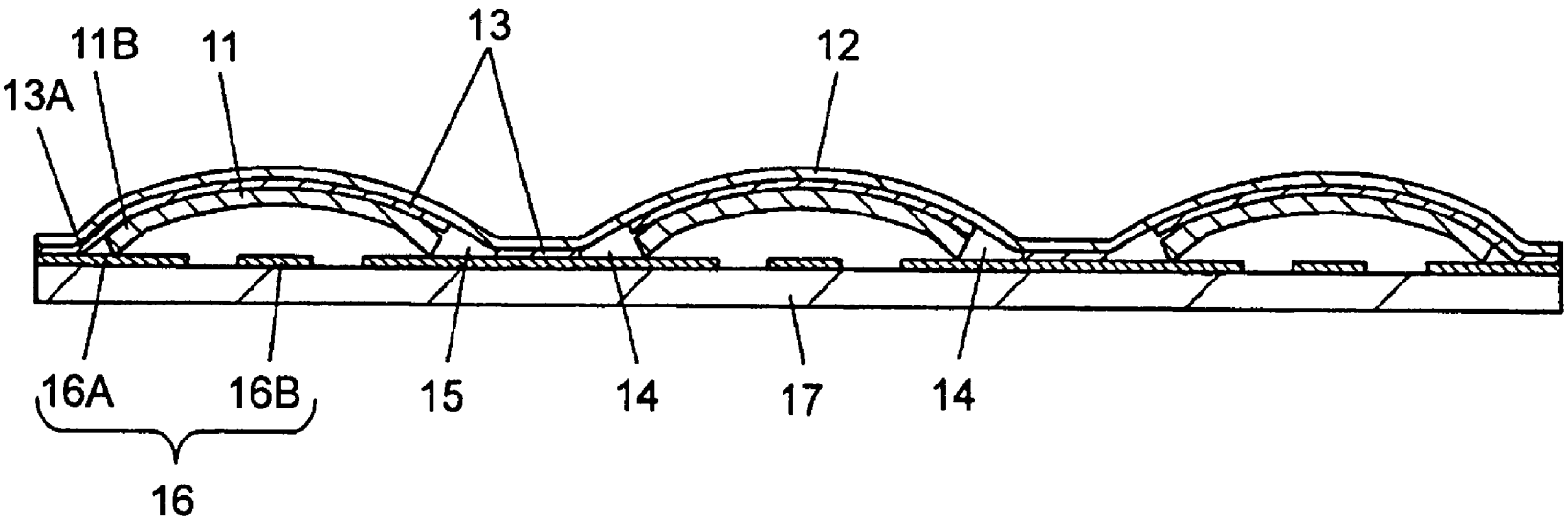
FIG. 3 is a sectional view of a panel switch configured using the movable contact unit in accordance with the preferred embodiment of the present invention.
Figure 4:
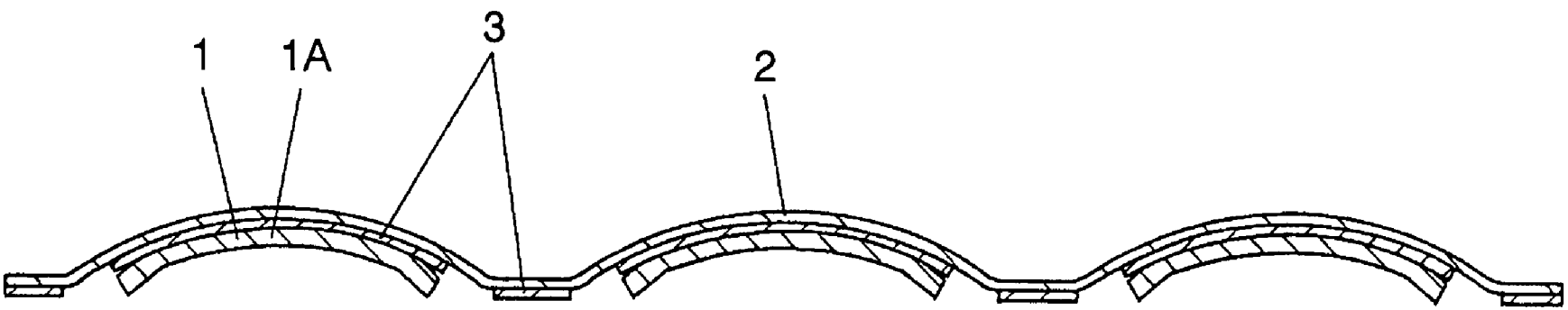
FIG. 4 PRIOR ART
FIG. 4 is a sectional view of a conventional movable contact unit.
Figure 5:
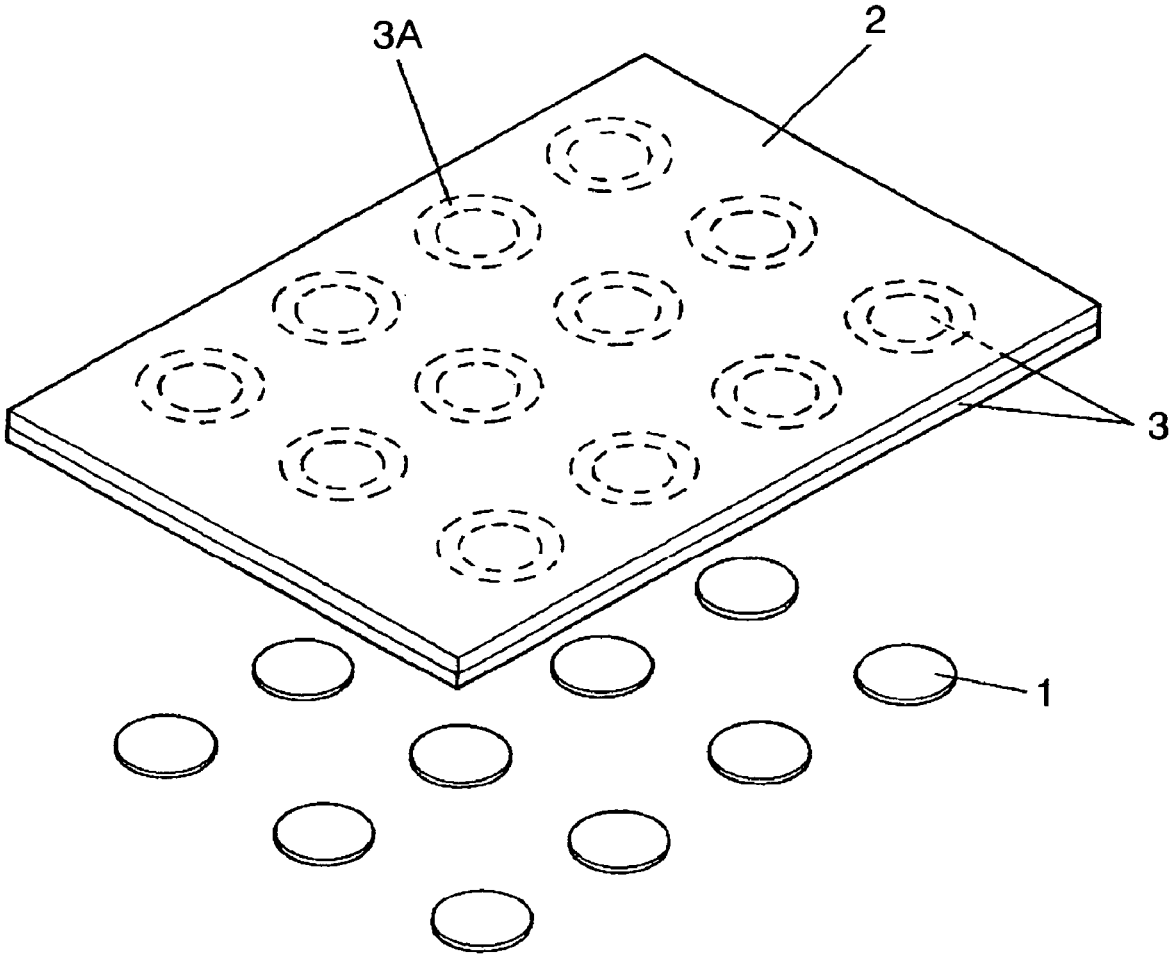
FIG. 5 PRIOR ART
FIG. 5 is an exploded perspective view of the conventional movable contact unit.
Figure 6:
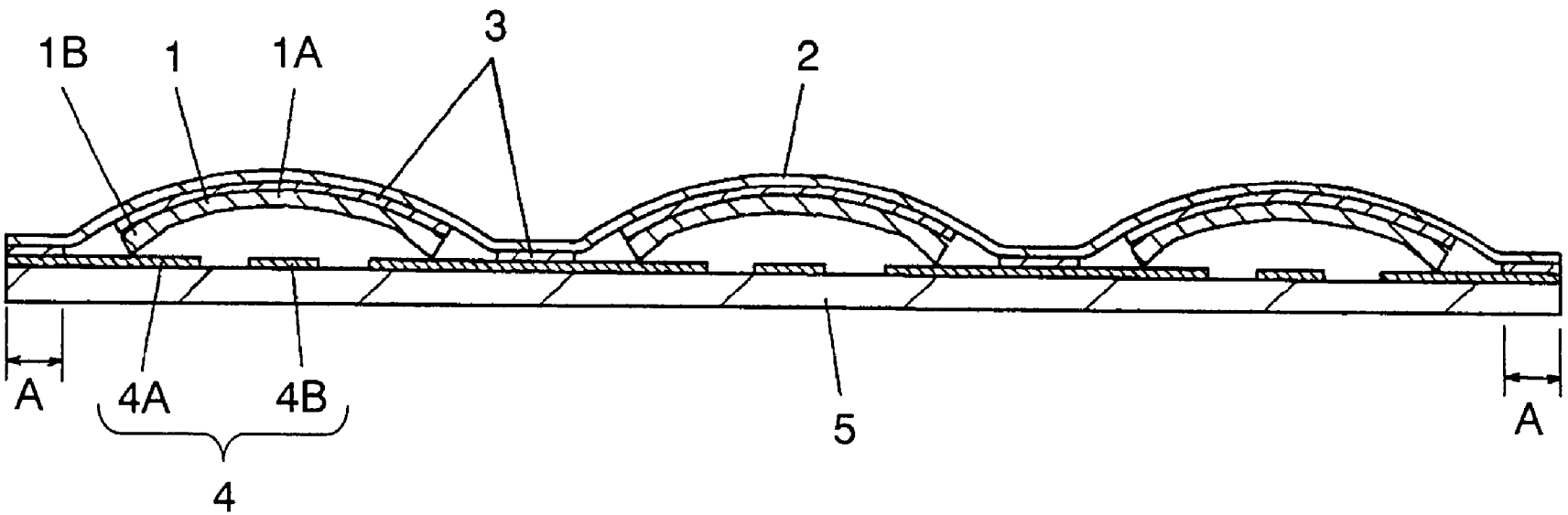
FIG. 6 PRIOR ART
FIG. 6 is a sectional view of a panel switch configured using the conventional movable contact unit.

FIG. 3 is a sectional view of a panel switch configured using the movable contact unit of the present invention as configured above.

In FIG. 3, the panel switch includes a movable contact unit having movable contacts 11 and base sheet 12, and wiring board 17. Fixed contacts 16, each consisting of outer fixed contact 16A and central fixed contact 16B, are disposed on the top face of wiring board 17 at positions corresponding to movable contacts 11 adhered and disposed on the undersurface of base sheet 12 of the movable contact unit. Peripheral lower end 11B of each movable contact 11 is placed on each outer fixed contact 16A, and attached onto the wiring board with adhesive 13 on the undersurface of base sheet 12.

As in the prior art, the movable contact unit of the present invention is protected from dust and foreign materials until the movable contact unit is attached to wiring board 17. For this purpose, a protective sheet made of an insulating film is applied to cover the entire undersurface of base sheet 12, and this protective sheet is removed on attaching the movable contact unit on wiring board 17.

In the above panel switch, each movable contact 11 provided near the edge of base sheet 12 is adhered to base sheet 12 by the adhesive, including supplementary adhesive 13A, toward the edge from the top face of movable contact 11 to its periphery. Since adhesive 13 applied to the border of base sheet 12 adheres to wiring board 17, an adhesive area and sufficient adhesive strength on the border of base sheet 12 are secured. Accordingly, peeling of the edge of base sheet 12 from wiring board 17 is preventable, even though movable contact 11 is disposed closer to the edge and the border width of base sheet 12 is set narrower than in the prior art.

An individual switch on the above panel switch is operated by depressing dome tip 11A of movable contact 11 from above base sheet 12 using an operation button (not illustrated) of an electronic device. This pressing force makes the dome resiliently deform, giving tactile feedback, and makes the undersurface of dome tip 11A contact central fixed contact 16B disposed underneath. Outer fixed contact 16A and central fixed contact 16B thus become electrically contiguous via movable contact 11, and the switch is turned on.

When the pushing force applied to movable contact 11 is released, movable contact 11 returns to its original dome shape with convex top due to its own resilience, again giving tactile feedback. The undersurface of dome tip 11A and central fixed contact 16B are separated, and thus the switch returns to the off state shown in FIG. 1.

As described above, in the panel switch using the movable contact unit of the present invention, the border of base sheet 12 adheres to wiring board 17 and also to movable contact 11 disposed near the edge. Accordingly, the adhesive area and the adhesive strength that meets the area on the border of base sheet 12 are secured, even though the border width of base sheet 12 is set narrower than that of the prior art. Peeling from the edge of base sheet 12 is thus preventable, offering a small panel switch with a contact point consisting of fixed contact 16 (16A and 16B) on wiring board 17 and movable contact 11 which shows good dust- and drip-proof characteristics.

The preferred embodiment refers to the printing of one type of adhesive 13 on the undersurface of base sheet 12 including supplementary adhesive 13A. However, the present invention is not limited to one type of adhesive. The use of one type of adhesive 13 is preferable for facilitating narrowing of the border of base sheet 12 at low cost, since adhesive 13 can be applied to base sheet 12 in a single step. However, it is apparent that a different adhesive may be used as supplementary adhesive 13A.

Still more, the area of application of supplementary adhesive 13A toward the edge of base sheet 12 is not limited. However, it is preferable to apply supplementary adhesive 13A on roughly a half circle at the edge side to achieve the required adhesive strength.

When the movable contact unit is incorporated in the panel switch, it is important to provide at least one outer fixed contact 16A for movable contact 11 disposed near the edge of base sheet 12 at a position corresponding to non-adhesive area 15. This prevents adhesive such as supplementary adhesive 13A from protruding into a contact point between movable contact 11 disposed near the edge and outer fixed contact 16A due to environmental changes and repetitive pushing operations. Accordingly, a small panel switch with reliable contacts is achievable.

As described above, the movable contacts disposed near the edge of the base sheet are adhered to and held by the base sheet with the adhesive including the supplementary adhesive applied in a way such that to join the adhesive applied to the border of the base sheet. This secures the adhesive area required at the border of the base sheet and sufficient adhesive strength even though the border width of the base sheet is narrowed. Accordingly, the present invention offers a small movable contact unit with its movable contacts disposed nearer to the edge of the base sheet, and a panel switch configured using this movable contact unit. The movable contact unit and panel switch of the present invention are thus advantageous, typically for panel switches on control panels of diverse electronic devices.

What is claimed is:

1. A movable contact unit comprising:

a base sheet made of an insulating film and having an undersurface, said undersurface having a main adhesive thereon;

a supplementary adhesive provided on said undersurface of said base sheet;

a first movable contact made of a resilient metal sheet, said first movable contact having a round dome shape with an open bottom, and a dome tip adhered to said undersurface of said base sheet by said main adhesive; and a second movable contact made of a resilient metal sheet, said second movable contact having a round dome shape with an open bottom, and a dome tip adhered to said undersurface of said base sheet by said main adhesive;

wherein a first ring-shaped area, in which no main adhesive and no supplementary adhesive is disposed, is formed on said undersurface of said base sheet about an entire periphery of said first movable contact;

wherein a second ring-shaped area, in which no main adhesive is disposed, is formed on said undersurface of said base sheet about an entire periphery of said second movable contact, a portion of said second ring-shaped area having no supplementary adhesive;

wherein said supplementary adhesive reaches said main adhesive; and wherein said second movable contact is adhered to said base sheet by said main adhesive and said supplementary adhesive.

2. The movable contact unit as defined in claim 1, wherein said second movable contact is closer than said first movable contact to an edge of said base sheet.

3. A panel switch comprising:

the movable contact unit as defined in claim 2;

a board having a surface adhered to said undersurface of said base sheet by said main adhesive;

a first outer fixed contact provided on said surface of said board, said first outer fixed contact contacting the periphery of said first movable contact;

a first central fixed contact provided on said surface of said board, said first central fixed contact facing said first movable contact;

a second outer fixed contact provided on said surface of said board, said second outer fixed contact contacting the periphery of said second movable contact; and a second central fixed contact provided on said surface of said board, said second central fixed contact facing said second movable contact.

4. The movable contact unit as defined in claim 2, wherein said supplementary adhesive is of the same type as said main adhesive.

5. A panel switch comprising:

the movable contact unit as defined in claim 4;

a board having a surface adhered to said undersurface of said base sheet by said main adhesive;

a first outer fixed contact provided on said surface of said board, said first outer fixed contact contacting the periphery of said first movable contact;

a first central fixed contact provided on said surface of said board, said first central fixed contact facing said first movable contact;

a second outer fixed contact provided on said surface of said board, said second outer fixed contact contacting the periphery of said second movable contact; and a second central fixed contact provided on said surface of said board, said second central fixed contact facing said second movable contact.

6. The movable contact unit as derived in claim 1, wherein said portion of said second ring-shaped area having no supplementary adhesive is substantially semicircular.

7. A panel switch comprising:

the movable contact unit as defined in claim 6;

a board having a surface adhered to said undersurface of said base sheet by said main adhesive;

a first outer fixed contact provided on said surface of said board, said first outer fixed contact contacting the periphery of said first movable contact;

a first central fixed contact provided on said surface of said board, said first central fixed contact facing said first movable contact;

a second outer fixed contact provided on said surface of said board, said second outer fixed contact contacting the periphery of said second movable contact; and a second central fixed contact provided on said surface of said board, said second central fixed contact facing said second movable contact.

8. The movable contact unit as defined in claim 6, wherein said supplementary adhesive is of the same type as said main adhesive.

9. A panel switch comprising:

the movable contact unit as defined in claim 8;

a board having a surface adhered to said undersurface of said base sheet by said main adhesive;

a first outer fixed contact provided on said surface of said board, said first outer fixed contact contacting the periphery of said first movable contact;

a first central fixed contact provided on said surface of said board, said first central fixed contact facing said first movable contact;

a second outer fixed contact provided on said surface of said board, said second outer fixed contact contacting the periphery of said second movable contact; and a second central fixed contact provided on said surface of said board, said second central fixed contact facing said second movable contact.

10. A panel switch comprising:

the movable contact unit as defined in claim 1;

a board having a surface adhered to said undersurface of said base sheet by said main adhesive;

a first outer fixed contact provided on said surface of said board, said first outer fixed contact contacting the periphery of said first movable contact;

a first central fixed contact provided on said surface of said board, said first central fixed contact facing said first movable contact;

a second outer fixed contact provided on said surface of said board, said second outer fixed contact contacting the periphery of said second movable contact; and a second central fixed contact provided on said surface of said board, said second central fixed contact facing said second movable contact.

11. The movable contact unit as defined in claim 1, wherein said supplementary adhesive is of the same type as said main adhesive.

12. A panel switch comprising:

the movable contact unit as defined in claim 11;

a board having a surface adhered to said undersurface of said base sheet by said main adhesive;

a first outer fixed contact provided on said surface of said board, said first outer fixed contact contacting the periphery of said first movable contact;

a first central fixed contact provided on said surface of said board, said first central fixed contact facing said first movable contact;

a second outer fixed contact provided on said surface of said board, said second outer fixed contact contacting the periphery of said second movable contact; and a second central fixed contact provided on said surface of said board, said second central fixed contact facing said second movable contact.

* * * * *